US008674248B2

(12) United States Patent
Deng

(10) Patent No.: US 8,674,248 B2
(45) Date of Patent: Mar. 18, 2014

(54) INPUT KEY AND MANUFACTURING METHOD THEREOF

(75) Inventor: Wei Deng, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 559 days.

(21) Appl. No.: 12/979,361

(22) Filed: Dec. 28, 2010

(65) Prior Publication Data

US 2012/0138438 A1 Jun. 7, 2012

(30) Foreign Application Priority Data

Dec. 1, 2010 (CN) ..... 2010 1 0568138

(51) Int. Cl.
*H01H 3/12* (2006.01)

(52) U.S. Cl.
USPC ..... 200/341

(58) Field of Classification Search
USPC ..... 200/341, 520, 345
See application file for complete search history.

(56) References Cited

U.S. PATENT DOCUMENTS

| | | | | |
|---|---|---|---|---|
| 5,032,698 | A * | 7/1991 | Satoh | 200/341 |
| 8,278,579 | B2 * | 10/2012 | Lin et al. | 200/345 |
| 2001/0023818 | A1 * | 9/2001 | Masaru et al. | 200/512 |
| 2008/0011589 | A1 * | 1/2008 | Ball et al. | 200/5 A |
| 2008/0093208 | A1 | 4/2008 | Seo et al. | |

FOREIGN PATENT DOCUMENTS

| | | | |
|---|---|---|---|
| CN | 2687816 | Y | 3/2005 |
| CN | 1901119 | A | 1/2007 |
| JP | 2004-213969 | A | 7/2004 |
| TW | 271856 | | 3/1996 |
| TW | 339025 | | 8/1998 |

* cited by examiner

*Primary Examiner* — Renee S Luebke
*Assistant Examiner* — Lheiren Mae Caroc
(74) *Attorney, Agent, or Firm* — Altis Law Group, Inc.

(57) ABSTRACT

A key includes a base and a top cover. The base is made of a non-plated first plastic material. The base defines a through hole in a center portion, and a plurality of receiving portions surrounding and communicating with the through hole. The top cover is made of plated second plastic material. The top cover forms a plurality of connecting portions received in the receiving portions of the base The top cover is covered with a metal plating layer. A method of manufacturing a key is also provided.

9 Claims, 6 Drawing Sheets

INPUT KEY AND MANUFACTURING METHOD THEREOF

BACKGROUND

1. Technical Field

The present disclosure relates generally to input keys and, more particularly, to a key for an electronic device and a manufacturing method thereof.

2. Description of Related Art

An electronic device generally has keys for operating the electronic device. Referring to FIG. 6, a commonly used key 100 includes a non-plated plastic layer 10 and a plated plastic layer 20 surrounding the non-plated plastic layer 10. The plated plastic layer 20 is covered with a metal plating layer 30. The key 100 is integrally formed by a double-shot mold (not shown).

However, if the key 100 is connected to a metal housing of the electronic device, current can easily pass therebetween. As a result, functions of the electronic device can be affected. In addition, the connection strength between the non-plated plastic layer 10 and the plated plastic layer 20 is low, whereby the two are easily separated.

Therefore, there is room for improvement within the art.

BRIEF DESCRIPTION OF THE DRAWINGS

The elements in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
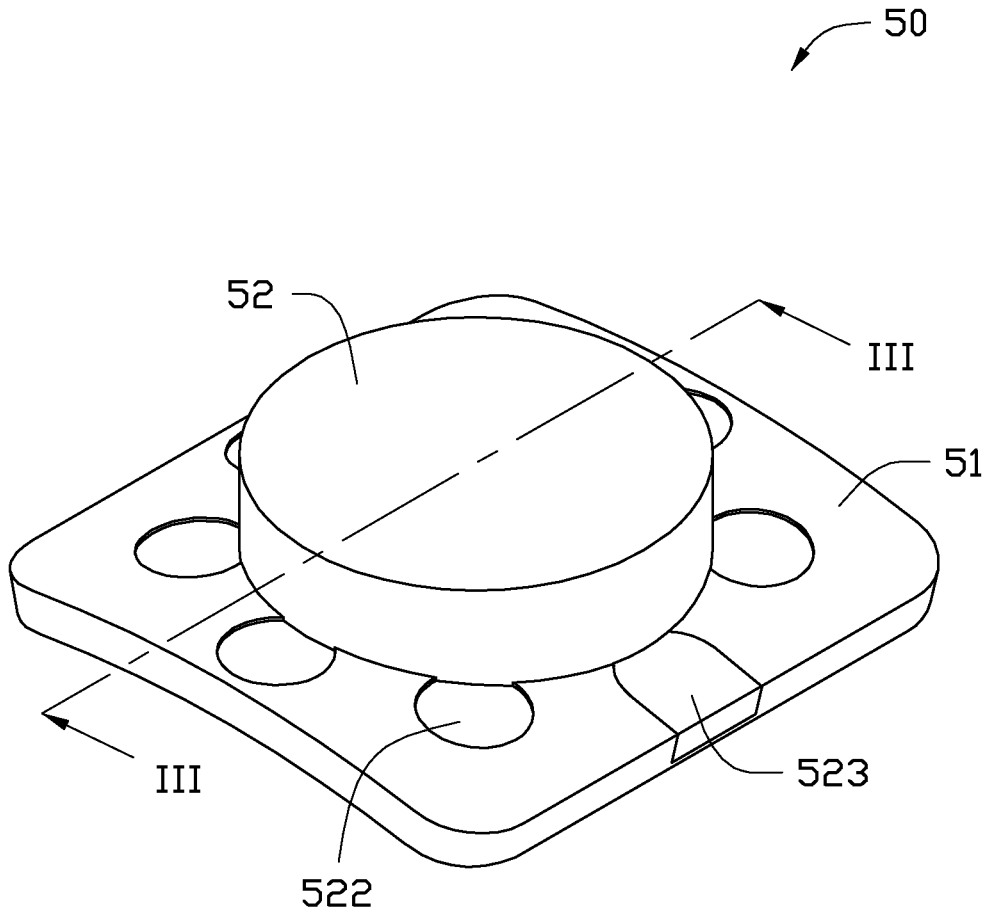
FIG. 1 is an isometric view of an embodiment of a key including a base and a top cover.

Referring to FIG. 1, an embodiment of a key 50 includes a base 51 and a top cover 52.

Figure 2:
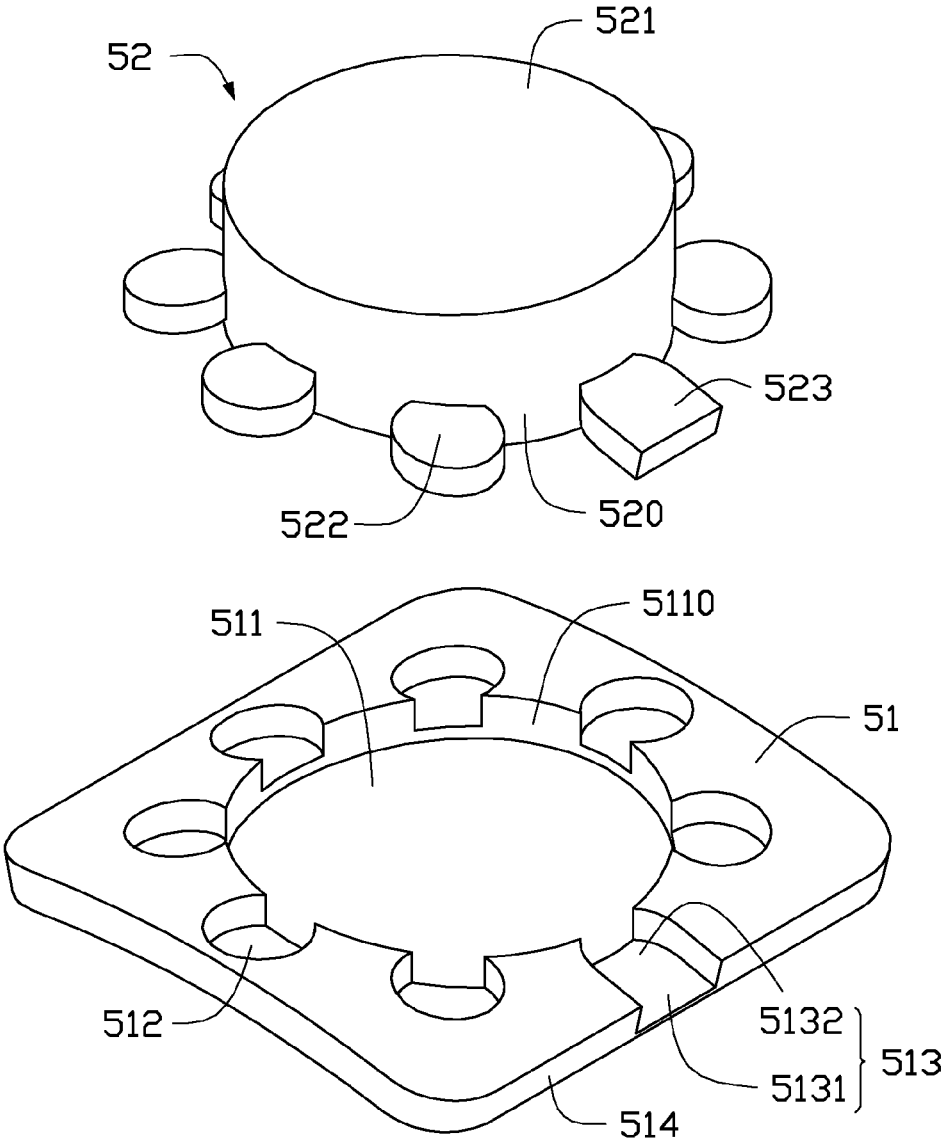
FIG. 2 is an exploded, isometric view of the key of FIG. 1.
Figure 3:
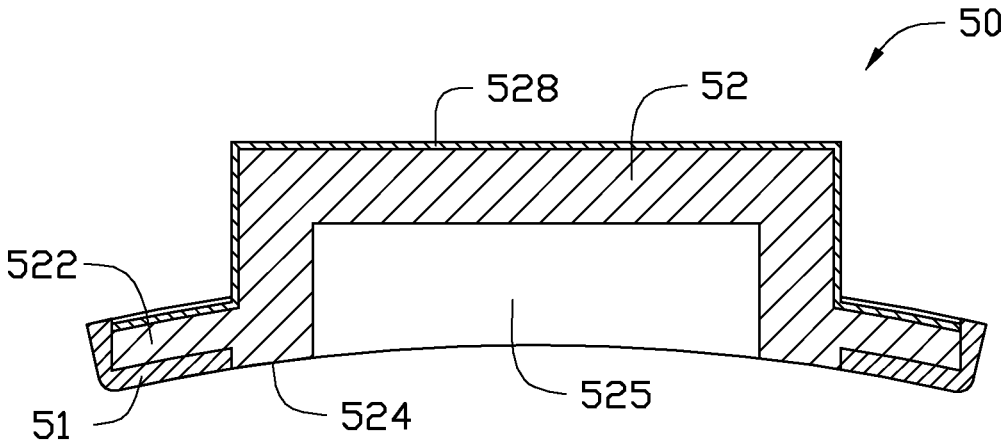
FIG. 3 is a cross-section of the key of FIG. 1, taken along line III-III.
Figure 4:
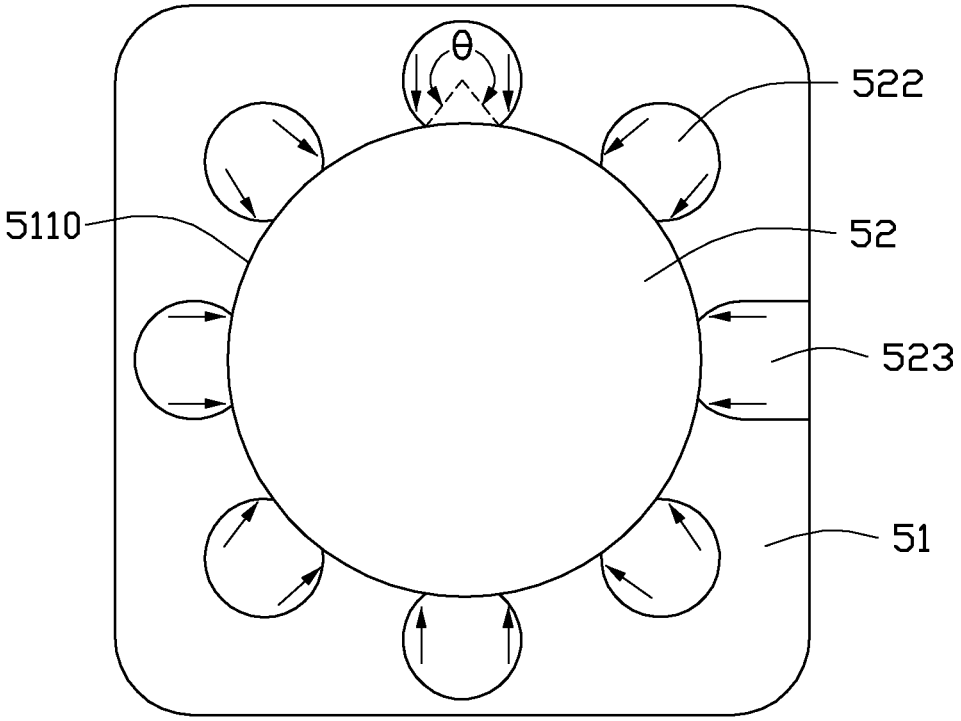
FIG. 4 is a top view of the key of FIG. 1.

Referring to FIGS. 2 and 3, the base 51 is curved and defines a substantially circular through hole 511 in a center portion. The base 51 further defines a plurality of first receiving portions 512 and a second receiving portion 513. The first receiving portions 512 and the second receiving portion 513 are aligned surrounding and communicating with the through hole 511. A width of a part of each first receiving portion 512 adjacent to the through hole 511 decreases towards the through hole 511. A width of a part of the second receiving portion 513 adjacent to the through hole 511 decreases towards the through hole 511. In the illustrated embodiment, the base 51 defines seven first receiving portions 512, each approximately hemispherical and having a cutout, with a central angle θ (see FIG. 4) of each corresponding to a center of the first receiving portion 512 exceeding 180°. The second receiving portion 513 communicates the through hole 511 with a side surface 514 of the base 51. The second receiving portion 513 includes a substantially rectangular section 5131 and a contraction section 5132 adjoining the rectangular section 5131. The base 51 is made of a non-plated first plastic material, such as polycarbonate (PC) or a mixture of PC and acrylonitrile butadiene styrene (ABS) of which PC accounts for more than 30% by weight.

The top cover 52 includes a cylindrical main body 521, and a plurality of first connecting portions 522 and a second connecting portion 523 extending from a side surface 520 of the main body 521. The first connecting portions 522 are received in the corresponding first receiving portions 512, and the second connecting portion 523 is received in the second receiving portion 513. The top cover 52 further defines an assembly groove 525 in a bottom surface 524 of the top cover 52. In the illustrated embodiment, the top cover 52 forms seven first connecting portions 522. The top cover 52 is made of a plating second plastic material, such as ABS or a mixture of ABS and PC of which PC accounts for less than 30% by weight. The top cover 52 comprises a metal plating layer 528.

Figure 5:
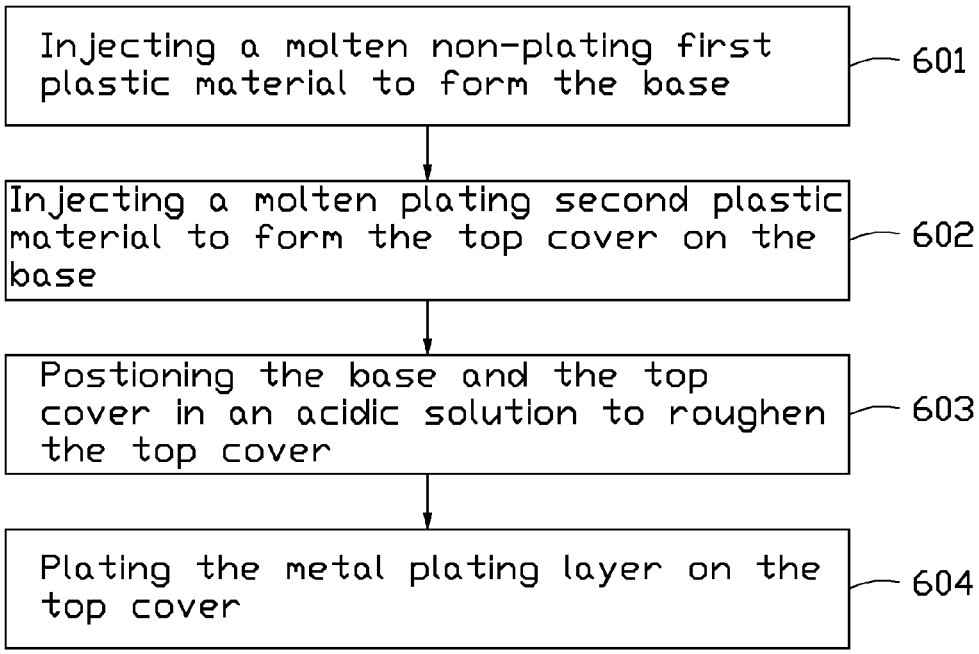
FIG. 5 is a flowchart of a method for manufacturing the key of FIG. 1.
Figure 6:
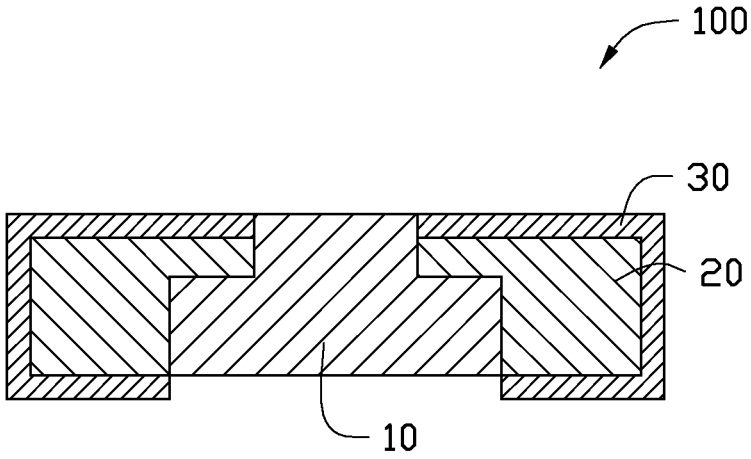
FIG. 6 (RELATED ART)
FIG. 6 is a cross-section of a commonly used key.

Referring to FIG. 5, the key 50 is integrally formed by an injection mold (not shown) as follows. In a first step 601, a molten first plastic material is injected in the injection mold and cooled, forming the base 51. In a second step 602, a molten second plastic material is injected towards the second receiving portion 513 of the base 51 in the injection mold, and cooled, forming a top cover 52 on the base 51. In a third step 603, the base 51 and the top cover 52 are together positioned in an acidic solution such that the top cover 52 is roughened by the acidic solution but the base 51 is not, because only the top cover 52 is made of plating second plastic material. In the illustrated embodiment, the acidic solution is vitriol solution. In a fourth step 604, in plating, the top cover 52 with a roughened surface is plated with a metal plating layer, and the base 51 is not, thereby achieving partial plating of the key 50.

When the second plastic material is injected in the base 51, a sidewall 5110 defining the through hole 511 is melted thereby. As a result, some first plastic material of the base 51 and some second plastic material of the top cover 52 blend at the sidewall 5110 after cooling. Thus, a combination strength of the base 51 and the cover 52 is enhanced. In addition, while cooling the molten second plastic material, the second plastic material applies extrusion forces on sidewalls of the first receiving portions 512 and the second receiving portion 513 along the arrows of FIG. 4. Therefore, a combination strength of the base 51 and the cover 52 is further enhanced.

It should be appreciated that the first receiving portions 512 and the second receiving portion 513 can be other shapes, such as trapezoids, as long as the width of the part of the first receiving portion 512 or the second receiving portion 513 adjacent to the through hole 511 decreases towards the through hole 511. In addition, the base 51 may only define one or more first receiving portions 512, and the top cover forms one or more first connecting portion correspondingly.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A key, comprising:

a base made of a non-plated first plastic material, the base defining a through hole in a center portion, and at least one receiving portion surrounding and communicating with the through hole, wherein a width of a part of the at least one receiving portion adjacent to the through hole decreases towards the through hole;

a top cover made of a plating second plastic material, the top cover forming at least one connecting portion received in the at least one receiving portion of the base; and a metal plating layer covering the top cover.

2. The key of claim 1, wherein the first plastic material is polycarbonate.

3. The key of claim 1, wherein the first plastic material is a mixture of polycarbonate and acrylonitrile butadiene styrene, and polycarbonate accounts for more than 30% in weight.

4. The key of claim 1, wherein the second plastic material is acrylonitrile butadiene styrene.

5. The key of claim 1, wherein the second plastic material is a mixture of acrylonitrile butadiene styrene and polycarbonate, and polycarbonate accounts for less than 30% in weight.

6. The key of claim 1, wherein the at least one receiving portion is approximately hemispherical, and a central angle of the at least one receiving portion corresponding to a center of the first receiving portions is greater than 180°.

7. The key of claim 1, wherein the receiving portion comprises a substantially rectangular section and a contraction section.

8. The key of claim 1, wherein the top cover defines an assembly hole in a bottom surface.

9. The key of claim 1, wherein the base is a curved piece.

* * * * *